US010918205B2

(12) United States Patent
Kwan

(10) Patent No.: US 10,918,205 B2
(45) Date of Patent: Feb. 16, 2021

(54) ADJUSTABLE SHELVING WITH TELESCOPING SUPPORTS

(71) Applicant: Steward Kwan, Astoria, NY (US)

(72) Inventor: Steward Kwan, Astoria, NY (US)

(73) Assignee: Steward Kwan, Astoria, NY (US)

( * ) Notice: Subject to any disclaimer, the term of this patent is extended or adjusted under 35 U.S.C. 154(b) by 0 days.

(21) Appl. No.: 16/391,795

(22) Filed: Apr. 23, 2019

(65) Prior Publication Data

US 2020/0337454 A1 Oct. 29, 2020

(51) Int. Cl.

| | |
|---|---|
| ***A47B 45/00*** | (2006.01) |
| ***A47B 57/06*** | (2006.01) |
| ***A47B 57/04*** | (2006.01) |
| ***A47B 47/00*** | (2006.01) |
| *A47B 43/00* | (2006.01) |

(52) U.S. Cl.

CPC ..... *A47B 45/00* (2013.01); *A47B 47/0083* (2013.01); *A47B 57/04* (2013.01); *A47B 57/06* (2013.01); *A47B 43/00* (2013.01); *A47B 47/00* (2013.01)

(58) Field of Classification Search

CPC . A47B 45/00; A47B 47/0083; A47B 47/0091; A47B 57/04; A47B 57/06; A47B 57/08; A47B 57/20; A47B 57/30; A47B 57/32; A47B 57/34; A47B 47/00; A47B 43/00

USPC ..... 211/187

See application file for complete search history.

(56) References Cited

U.S. PATENT DOCUMENTS

| | | | | |
|---|---|---|---|---|
| 2,944,780 A * | 7/1960 | Monk | A47B 57/10 | 248/218.4 |
| 4,403,702 A * | 9/1983 | Belokin, Jr. | A47F 5/04 | 211/189 |
| 4,550,838 A * | 11/1985 | Nathan | A47B 87/0223 | 211/126.12 |
| 5,218,914 A * | 6/1993 | Dickinson | A47B 87/0223 | 108/186 |
| 6,062,150 A * | 5/2000 | Sikora | A47B 87/0223 | 108/190 |
| 6,202,867 B1 * | 3/2001 | Di Blasi | A47B 47/0075 | 108/138 |
| 6,247,414 B1 * | 6/2001 | Sikora | A47B 87/0223 | 108/147.13 |
| 7,516,856 B2 * | 4/2009 | Lee | A47B 81/04 | 211/189 |

(Continued)

*Primary Examiner* — Jonathan Liu
*Assistant Examiner* — Devin K Barnett

(57) ABSTRACT

A utility storage system is provided, the system comprising a plurality of flat panels, the panels disposed atop one another. The system also comprises a plurality of vertically disposed support devices to provide support for panels disposed above. The system also comprises connectors disposed at corners of upward facing surfaces of the panels, the connectors providing seating for bases of the support devices. The supports are extensible and retractable. The panels comprise shelves that are positioned in one of a level manner and an angled manner. The shelves are disposed at one of uniform and non-uniform vertical distances from one another. The vertical distances are adjustable via one of extension and retraction of the support devices. Extension and retraction are effected via use of a telescoping feature of the support devices. Each support device contains a locking mechanism for securing height of associated support device.

12 Claims, 4 Drawing Sheets

(56) References Cited

U.S. PATENT DOCUMENTS

| | | | | |
|---|---|---|---|---|
| 8,459,476 | B2 * | 6/2013 | Malekmadani | A47B 87/0223 211/134 |
| 9,930,963 | B2 * | 4/2018 | Guizzardi | A47B 57/265 |
| 10,092,099 | B1 * | 10/2018 | Linari | A47B 87/0223 |
| 2006/0091096 | A1 * | 5/2006 | Velez | B62B 3/10 211/194 |
| 2010/0071994 | A1 * | 3/2010 | Tseng | E06C 1/125 182/27 |
| 2010/0117499 | A1 * | 5/2010 | Fortier | A45C 13/02 312/306 |
| 2015/0351533 | A1 * | 12/2015 | Reinhart | A47B 96/06 211/188 |
| 2016/0331135 | A1 * | 11/2016 | Knudson | A47B 47/0091 |
| 2018/0361939 | A1 * | 12/2018 | Hughes | B60R 5/045 |
| 2019/0098995 | A1 * | 4/2019 | Brown | A47B 61/04 |

* cited by examiner

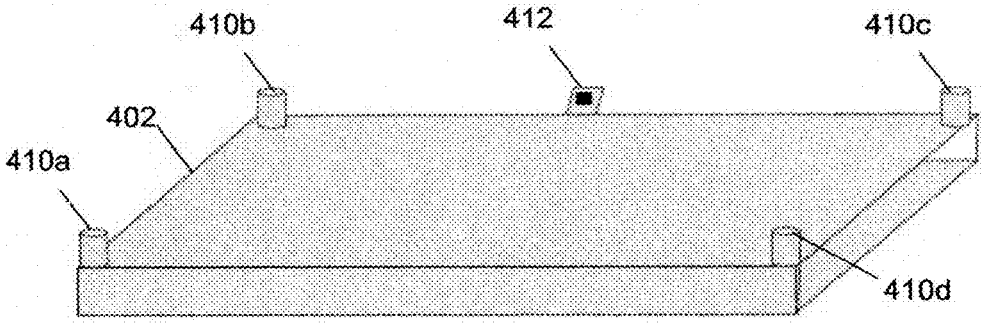
FIG. 4
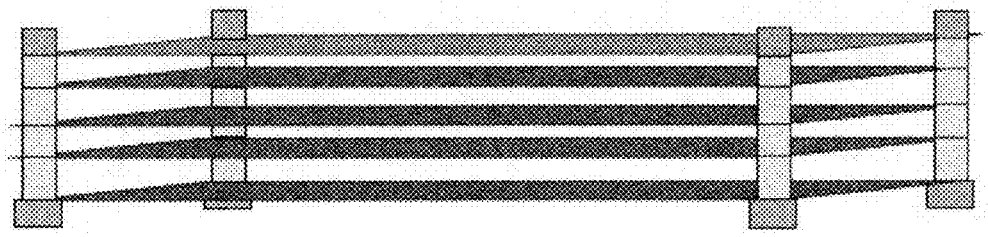
FIG. 5
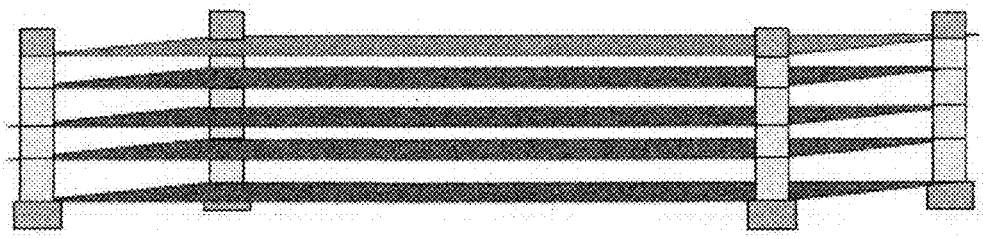

ADJUSTABLE SHELVING WITH TELESCOPING SUPPORTS

CROSS REFERENCE TO RELATED APPLICATIONS

None

FIELD OF THE DISCLOSURE

The present disclosure is in the field of storage of small items. More particularly, the present disclosure provides systems and methods positioning shelving to more efficiently store such items using adjustable supports below shelves.

BACKGROUND OF THE DISCLOSURE

Traditional cabinets, frames, bookcases and racks do not efficiently use shelf space. Shelves cannot be precisely located such that valuable space above shelved items but below an immediately above shelf may be wasted. The total number of shelves is also limited. The user must settle for available shelf positions built into the item of furniture. Users are also limited by the overall dimensions of the cabinet or frame itself and cannot exceed the height of the cabinet.

BRIEF DESCRIPTION OF THE DRAWINGS

FIG. 4 is a diagram of a system of adjustable shelving with telescoping leg support according to an embodiment of the present disclosure.

FIG. 5 is a diagram of a system of adjustable shelving with telescoping leg support according to an embodiment of the present disclosure.

DETAILED DESCRIPTION OF THE INVENTION

Systems and methods described herein provide for a plurality of shelves atop each other in a shelving system to be individually positioned vertically using adjustable supports. Each corner of a shelf is supported and held in place by a vertical support below the shelf that is telescoping in structure. Each support may be extended or retracted as needed to achieve the desired amount of space between shelves.

Vertical distance between shelves may be changed via adjusting height of supports by extending or retracting supports as needed. The telescoping feature of the supports provides the user choices in setting the vertical distances between shelves. Each support contains a locking mechanism for securing the support's configured height and enabling the support and its three fellow supports to bear the weight of the shelves above as well as contribute to the stability of the overall structure.

Each shelf has at its four corners a connector, a vertical protrusion that functions as a base for the telescoping support that is situated at the particular corner. The connector contributes to the stability of the structure.

In an embodiment, some or all the shelves may not be level and may instead may be angled or sloped downward toward the user. The rear pair of supports below a shelf that the user wishes to be angled may be longer, i.e. vertically taller, than the front pair of supports. Angling of the shelves downward toward the user may improve the user's view of the items on the shelf, particularly when the shelf is above the user's eye level.

Flanging or non-skid surfacing may be placed on an angled shelf to prevent objects on the shelf from sliding. When the user wishes to store, for example, shoes on an angled shelf, such flanges or other surfacing may allow the shoes to remain on the angled shelf without sliding forward.

Connectors on angled shelves may be flexible to provide secure seating of telescoping supports resting on the angled shelves. The base components of telescoping supports may also be flexible to join tightly with the connectors on such non-level surfaces.

Figure 1:
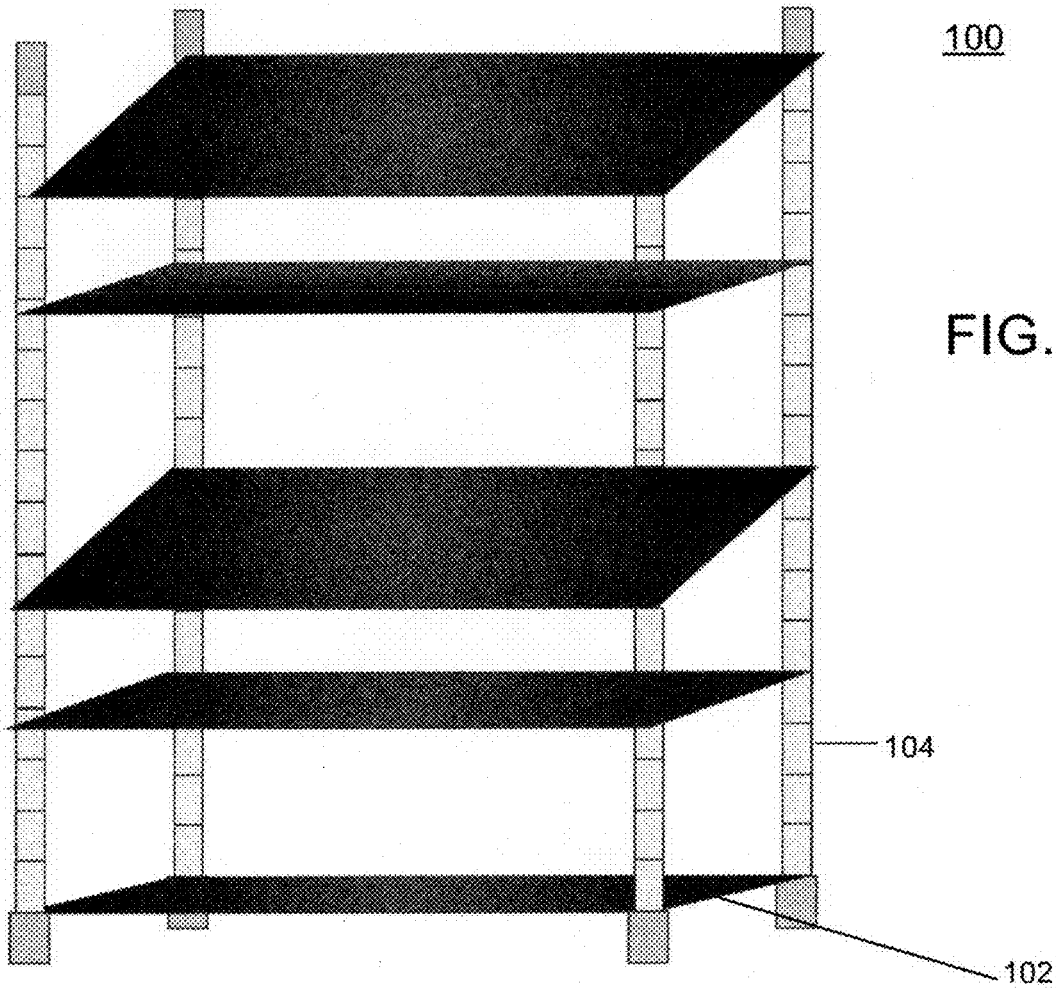
FIG. 1 is a diagram of a system of adjustable shelving with telescoping leg support according to an embodiment of the present disclosure.

Turning to the figures, FIG. 1 is a diagram of a system of adjustable shelving with telescoping leg support according to an embodiment of the present disclosure. FIG. 1 depicts a shelving system 100 as provided herein including shelves. 102 and telescoping supports 104. Only one each is enumerated in FIG. 1 but the enumeration shown applies to all instances of shelves and supports depicted in FIG. 1. The shelving system 100 in FIG. 1 is shown at an abstract level without individual details of the shelves 102 and telescoping supports 104 shown. The shelving system 100 is shown at a suggested but not mandatory maximum vertically extendable height. Wherein five total shelves are shown, such depiction is for discussion purposes only. In embodiments, less than or more than five total shelves may be physically feasible as well as safe and may depend on the weights and locations of items placed on the shelves 102 as well as the vertical distances between the shelves 102.

In an embodiment, the shelf 102 may be about 40 inches wide, about twelve inches deep, and about one centimeter in height. In an embodiment, shelves 102 may have a maximum vertical distance of 21 inches between them. In other embodiments, each of these dimensions may be less than or greater than these specified dimensions.

Figure 2:
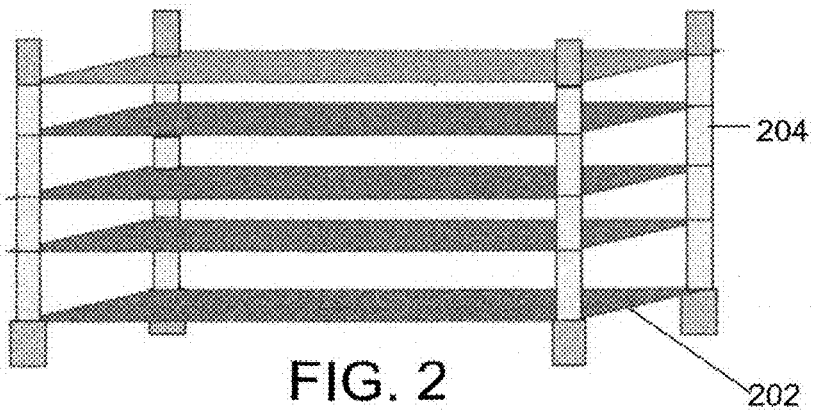
FIG. 2 is a diagram of a system of adjustable shelving with telescoping leg support according to an embodiment of the present disclosure.

FIG. 2 is a diagram of a system of adjustable shelving with telescoping leg support according to an embodiment of the present disclosure. Components shown in FIG. 2 comprising a shelving system 200 are indexed to the components provided by system 100. The shelving system 200 is shown in collapsed state wherein telescoping supports 204 are in fully retracted states and shelves 202 are in a stacked state. When the shelving system 200 is in such fully collapsed state, shelving systems 200 may be stacked atop each other for storage as is illustrated in FIG. 5.

Figure 3:
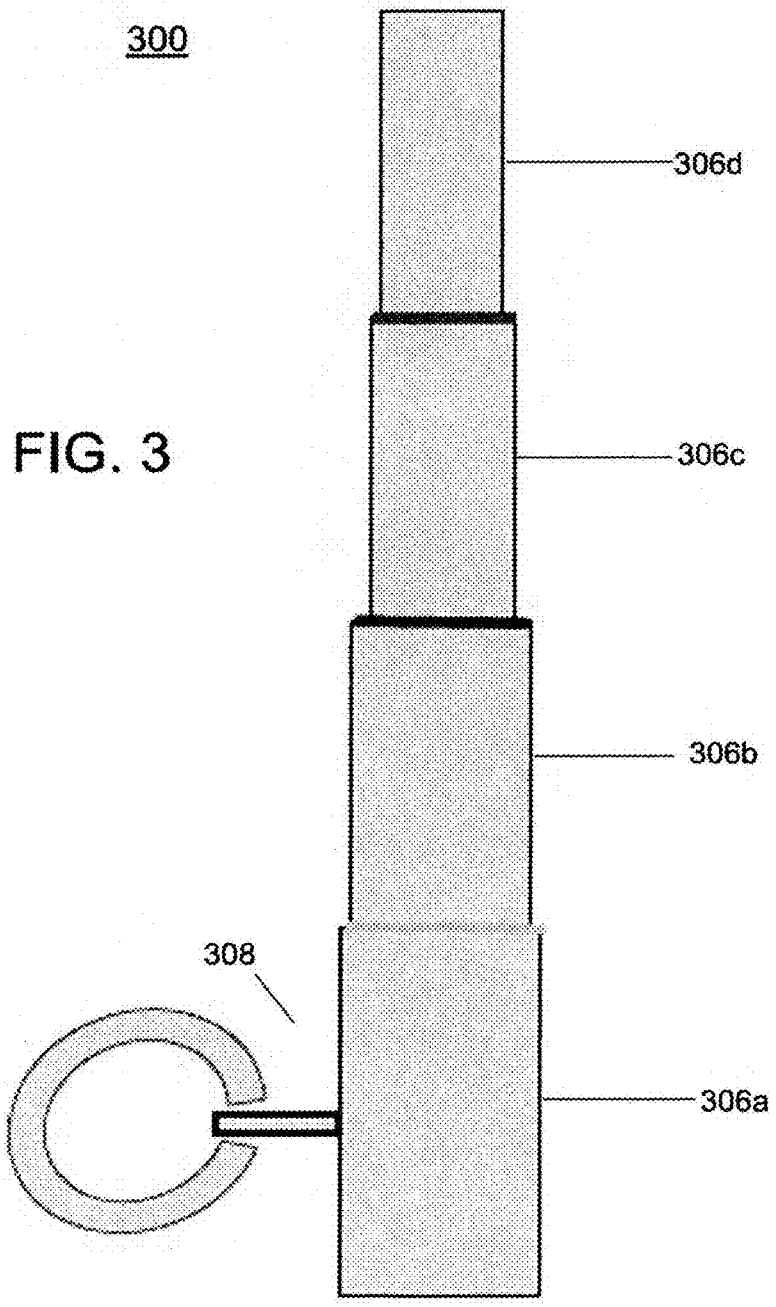
FIG. 3 is a diagram of a system of adjustable shelving with telescoping leg support according to an embodiment of the present disclosure.

FIG. 3 is a diagram of a system of adjustable shelving with telescoping leg support according to an embodiment of the present disclosure. FIG. 3 depicts a system 304 comprising a detailed view of the telescoping support 104. Sections 306*a-c* are shown. While FIG. 3 depicts four such sections 306*a-c*, in embodiments less than or more than four sections 306*a-c* may be components of the system 300.

The lengths of the sections 306*a-c* as shown in FIG. 3 are for illustration and discussion purposes only and actual lengths may differ from what appears in FIG. 3. In an embodiment, when in fully retracted state, the telescoping support 104 may be two inches in height and when in fully extended state, the telescoping support 104 may be twenty-one inches in height.

In an embodiment, section 306*a* may be two inches in height, section 306*b* may be five inches in height, section 306*c* may be five inches in height, and section 306*d* may be nine inches in height. These may be maximum heights when the telescoping support 104 is fully extended. In other embodiments, each of these dimensions may be less than or greater than these specified dimensions.

While not shown in FIG. 3, each of the sections 306*a-c* may display some color coding to make accurate sizing of the telescoping support 104 easier for the user. Also, the telescoping support 104 may be set at any size between the minimum and maximum allowed sizes instead of merely at the end points of the sections 306*a-c* that may be marked by color coding.

FIG. 3 also depicts a locking mechanism 308 that secures the telescoping support 104 at its selected length by the user. When the locking mechanism 308 is turned, it secures the support 104 such that it will better support the weight of the above shelves and stored contents.

FIG. 4 is a diagram of a system 400 of adjustable shelving with telescoping leg support according to an embodiment of the present disclosure. FIG. 4 depicts a shelf 402 corresponding to the shelf 102 of system 100. FIG. 4 includes connectors 410*a-d*, one for each corner.

As noted, the connectors 410 may be flexibly attached to the shelf 402 to promote firm attachment and seating of the telescoping support 104 to the shelf 102 when the shelf 102 is angled. The connector 410 may be adjustable in its own angle to the shelf 102 to accommodate such angling. In another embodiment, some shelves 102 may be available with connectors 410 at fixed angles that are not 90° to accommodate such angling of shelf 102. Base sections of telescoping supports 104 may be flexibly attached such that such base sections may be adjustable vis a vis the main section of the telescoping support to accommodate such angling. Top sections of telescoping supports 104 may similarly be flexibly angled to support angling of a supported shelf 102.

System 400 also includes a safety latch 412 extending from a back edge of the shelf. The safety latch 412 may be used to attach the entire system to a wall or other fixed surface to prevent the system from being accidentally pulled forward or tipping forward if the system is improperly loaded.

FIG. 5 is a diagram of a system of adjustable shelving with telescoping leg support according to an embodiment of the present disclosure. FIG. 5 depicts quantity two of the system 100 in fully collapsed state, one on top of the other. When in such collapsed state, instances of the system 100 may be stacked atop one another for storage. The base sections of the telescoping supports 104 at the bottom of the instance of system 100 that is to be the upper of the two stacked systems 100 may fit compactly over the top sections of the uppermost telescoping supports 104 at the top of the instance of the system 100 that is to be the lower of the stacked systems 100.

Figure 6:
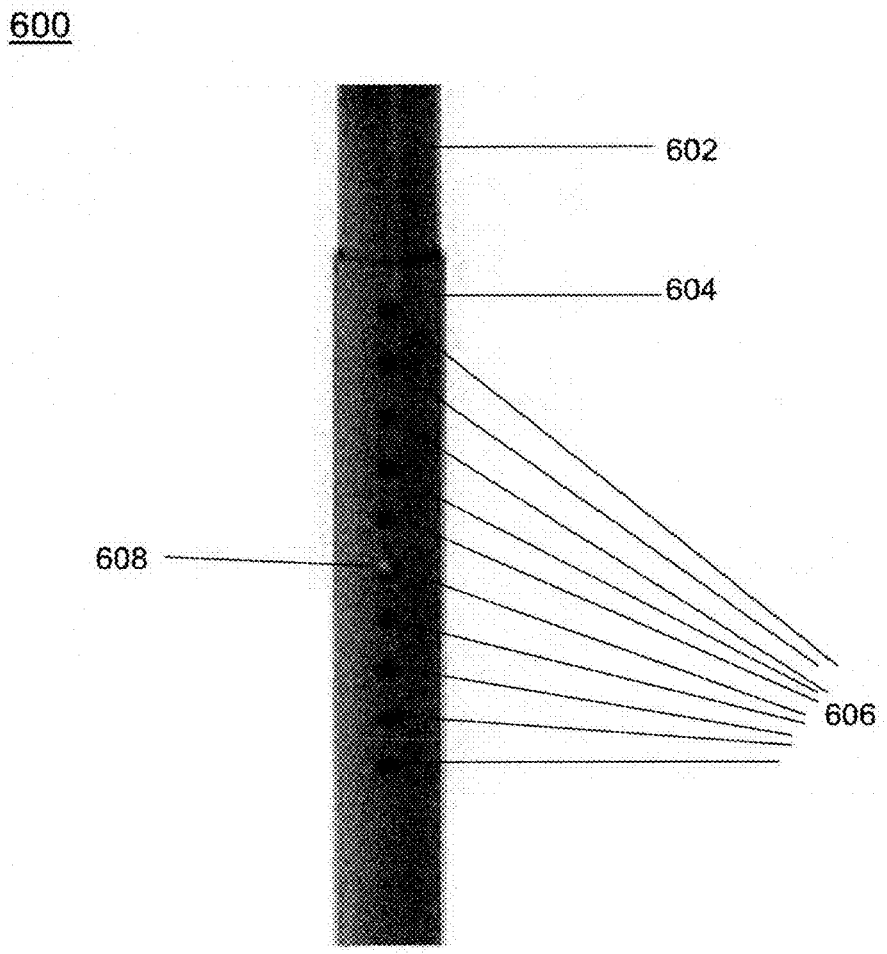
FIG. 6 is a diagram of a system of adjustable shelving with telescoping leg support according to an embodiment of the present disclosure.

FIG. 6 is a diagram of a system of adjustable shelving with telescoping leg support according to an embodiment of the present disclosure. In an embodiment, the supports 104 may not be telescoping as previously described and as specifically depicted in FIG. 3. Instead, in an embodiment, supports for shelves 102 may comprise two tubes, with a first tube disposed inside a second tube, the second tube including a line of holes and the first tube including a protrusion that may be motivated by a spring. The protrusion may be manually depressed as the user chooses a length for the support and then allowed to "pop-up" through the hole chosen by the user that is appropriate for the height of the support in the user's judgment.

FIG. 6 depicts the first tube 602 inside the second tube 604. The first tube 602 hosts the protrusion 608 that, as noted, is spring-motivated such that it normally is situated in an "up" state but can be manually depressed by the user while the user is manually sliding the first tube 602 inside the second tube 604 as the user selects a desired length of the support. The second tube 604 has holes 606 in a line along its length that correspond to different heights that the user may choose as the desired size of the support. While FIG. 6 depicts quantity ten (10) such holes 606, in embodiments more than or less than ten such holes 606 may be disposed along the length of the second tube.

Systems and methods provided herein are directed to individually adjusting the supports below shelves such that shelves may be of nearly any level. Whether telescoping supports are used or the tubes discussed above, each of the four supports below a shelf is individually adjust to whatever height the user deems is best for supporting a shelf to meet his or her storage needs.

In embodiments and as variously noted, bottom ends or base sections of telescoping supports 104 or legs abut the upper surfaces of shelves 102 and are affixed in place via a coupling of the telescoping supports 104 to connectors 410 that are located at each corner of the upper surfaces of the shelves. The connectors 410 are flexible and can be adjusted to receive the telescoping supports 104 or legs in a vertical upright manner even though the shelf 102 itself upon which the telescoping support 104 rests may be angled. The flexibility or bendability of the connectors 410 permits the connectors 410 to adjust to telescoping supports 104 or legs resting in vertical upright manner on angled shelves 102.

What is claimed is:

1. A system for storage of items, comprising:

at least two panels stacked on top of each other, at least one of the at least two panels is an angled panel in a sloped disposition; a plurality of telescopic legs extending vertically between each adjacent pair of panels from said at least two panels to space each adjacent pair of panels apart a vertical distance, wherein each vertical distance is adjustable; and hollow connectors disposed at corners of each panel, wherein the connectors extend upwardly from a top surface of each panel respectively, wherein each connector and the top surfaces of each panel define cavities which receive bottom portions of corresponding telescopic legs so that the bottom portions of the corresponding telescopic legs abut the top surfaces of each panel respectively;

wherein the connectors are flexible so that angles of the connectors are adjustable to receive corresponding telescopic legs in a vertical upright manner on a corresponding angled panel.

2. The system of claim 1, wherein a locking mechanism secures a height of each leg respectively.

3. The system of claim 2, wherein each locking mechanism is releasable to change a height of each leg respectively.

4. The system of claim 1, wherein each adjacent pair of panels are disposed at one of uniform and non-uniform vertical distances from one another.

5. A racking structure, comprising:

multiple shelves disposed in a stacked manner, wherein each shelf is at least one of a level shelf in a horizontal disposition and an angled shelf in a sloped disposition;

multiple supports extending vertically between each adjacent pair of shelves from said multiple shelves to vertically space each adjacent pair of shelves apart in the stacked manner;

wherein hollow connectors extend upwardly from a top surface of each shelf at corners thereof respectively, wherein each connector and the top surfaces of the multiple shelves define cavities which receive bottom portions of corresponding supports so that the bottom portions of the corresponding supports abut the top surfaces of the multiple shelves respectively;

wherein at least one of the shelves is an angled shelf;

wherein the connectors are flexible so that angles of the connectors are adjustable to receive corresponding supports in a vertical upright manner on a corresponding angled shelf.

6. The system of claim 5, wherein each shelf is an angled shelf in the sloped disposition; wherein the supports are adjustable in height to facilitate angling the shelves and adjust vertical distances between the shelves.

7. The system of claim 5, wherein the connectors are configured to accommodate angling of corresponding angled shelves.

8. The system of claim 5, wherein the supports are each adjustable in height via a telescoping structure promoting extension and retraction of each support respectively.

9. The system of claim 5, wherein the shelves are disposed at one of uniform and non-uniform vertical distances from one another.

10. The system of claim 9, wherein the vertical distances are adjustable via one of extension and retraction of the supports.

11. The system of claim 10, wherein the one of extension and retraction is accomplished via use of a telescoping feature of the supports.

12. The system of claim 11, wherein each support contains a locking mechanism for securing a height of each support.

* * * * *